US007624822B2

(12) United States Patent
Olsson et al.

(10) Patent No.: US 7,624,822 B2
(45) Date of Patent: Dec. 1, 2009

(54) THREAD JOINT

(75) Inventors: Urban Olsson, Forsbacka (SE); Monica Olsson, legal representative, Gävle (SE); Per-Olof Liljebrand, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 1107 days.

(21) Appl. No.: 10/492,370

(22) PCT Filed: Oct. 9, 2002

(86) PCT No.: PCT/SE02/01839

§ 371 (c)(1),
(2), (4) Date: Sep. 10, 2004

(87) PCT Pub. No.: WO03/042493

PCT Pub. Date: May 22, 2003

(65) Prior Publication Data

US 2008/0304904 A1 Dec. 11, 2008

(30) Foreign Application Priority Data

Oct. 12, 2001 (SE) ..... 0103407

(51) Int. Cl.
*E21B 10/36* (2006.01)

(52) U.S. Cl. ..... 175/293; 175/414; 166/242.6; 285/333

(58) Field of Classification Search ..... 175/293, 175/414; 166/242.6; 285/333
See application file for complete search history.

(56) References Cited

U.S. PATENT DOCUMENTS 3,645,570 A 2/1972 Johansson et al.
4,968,068 A * 11/1990 Larsson ..... 285/390

(Continued)

FOREIGN PATENT DOCUMENTS

WO WO 82/03653 10/1982

(Continued)

*Primary Examiner*—Shane Bomar
(74) *Attorney, Agent, or Firm*—Drinker Biddle & Reath LLP

(57) ABSTRACT

A thread joint for transmitting percussive forces includes a male thread on a male member and a female thread on a female member. The male member includes a first portion including an outer surface having a maximum first outer cross section, a second portion having a second maximum outer dimension, and a third portion having the male thread formed thereon. The second portion is disposed axially between the first and third portions. The male thread includes a thread start and a thread end. The third portion terminates in an axially facing first end surface. The female member has a recess in which the female thread is formed, the female thread having a mouth defined by a ring-shaped second end surface. The recess includes a cylindrical inner surface disposed between the second end surface and the female thread. The inner surface faces the cylindrical center portion of the male member. The inner surface has a diameter at least as large as the second maximum outer cross-sectional dimension, and smaller than the first maximum cross section. A first imaginary cylinder constituting an axial extension of the inner surface intersects the first portion of the male member, and a second imaginary cylinder constituting an axial extension of an outermost surface of the female member extends outside of the first portion of the male member.

29 Claims, 3 Drawing Sheets

U.S. PATENT DOCUMENTS

| | | | | |
|---|---|---|---|---|
| 5,785,360 | A * | 7/1998 | Nordfeldt et al. | 285/328 |
| 6,767,156 | B1 * | 7/2004 | Larsson | 403/343 |
| 7,185,721 | B2 * | 3/2007 | Carlstrom et al. | 175/414 |
| 2002/0074797 | A1 * | 6/2002 | Liljebrand et al. | 285/333 |

FOREIGN PATENT DOCUMENTS

| | | |
|---|---|---|
| WO | WO 87/04487 | 7/1987 |

* cited by examiner

Fig. 1B
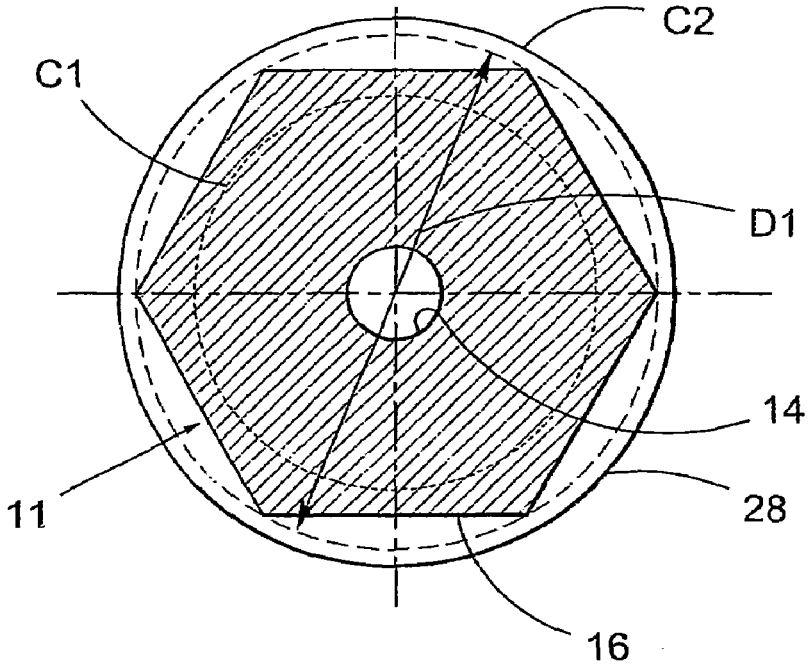
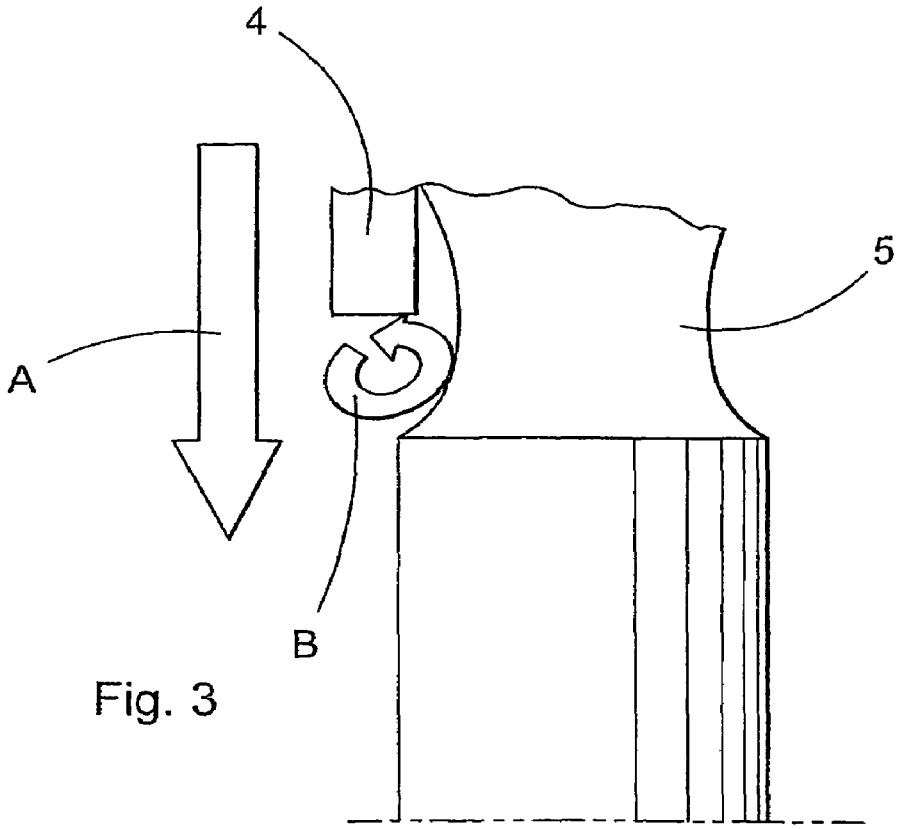
Fig. 3

THREAD JOINT

TECHNICAL FIELD OF THE INVENTION

The present invention relates to a thread joint intended for percussive rock drilling.

PRIOR ART

Thread joints in drill strings are exposed to large loads in percussive top hammer drilling, wherein the drill string has the object of transferring percussive energy from a top hammer to a carbide-tipped drill bit at the free end of the drill string. Usually, the individual drill rod has, at an end, a formed female thread intended to receive a male thread at an opposite end of another drill rod. In connection with drilling, for removing drill dust out of the bore hole as well as lubricating and cooling the drill bit, water is usually used as flushing medium, possibly with certain additives, e.g. for improving the lubrication. The drill steel, i.e. the material in bits, bars, tubes, sleeves and shank adapters, is during drilling exposed to abrasive and corrosive attacks. In particular, this is the case in drilling underground where water is used as flushing medium and where the environment generally is damp. The attacks are especially serious in parts having relatively small diameters, i.e. at thread ends of thread clearances 5, the latter one of which is illustrated in FIG. 3 connected to a sleeve 4 of a drill bit. The flushing medium with drill dust travels in the return direction A at a relatively high speed. Thereby, vortex vortices B are formed by abrasion at marked dimension-changes.

OBJECTS AND FEATURES OF THE INVENTION

The present invention aims at obviating the above-mentioned problems and at providing an improved thread joint for percussive rock drilling, which additionally improves the efficiency in modern mining.

Another object of the present invention is to provide a thread joint, which reduces the formation of vortex vortices in percussive drilling.

The present invention aims at obviating the above-mentioned problems and at providing an improved thread joint for percussive rock drilling, which additionally improves the efficiency in modern mining.

Another object of the present invention is to provide a thread joint, which reduces the formation of vortex vortices in percussive drilling.

Another object of the present invention is to provide a thread joint at which blasting effects and corrosion from exterior flushing medium is reduced.

SUMMARY OF THE INVENTION

A thread joint for transmitting percussive forces includes a male thread on a male member and a female thread on a female member. The male member includes a first portion including an outer surface having a maximum first outer cross section, a second portion having a second maximum outer dimension, and a third portion having the male thread formed thereon. The second portion is disposed axially between the first and third portions. The male thread includes a thread start and a thread end. The third portion terminates in an axially facing first end surface. The female member has a recess in which the female thread is formed, the female thread having a mouth defined by a ring-shaped second end surface. The recess includes a stop face abutted by the first end surface. The recess includes a cylindrical inner surface disposed between the second end surface and the female thread. The inner surface faces the cylindrical center portion of the male member. The inner surface has a diameter at least as large as the second maximum outer cross-sectional dimension, and smaller than the first maximum cross section. The thread end of the male thread is situated within the recess. A first imaginary cylinder constituting an axial extension of the inner surface intersects the first portion of the male member, and a second imaginary cylinder constituting an axial extension of an outermost surface of the female member extends outside of the first portion of the male member. The male and female members form a conduit for transporting a flushing medium.

BRIEF DESCRIPTION OF THE DRAWINGS

The objects and advantages of the invention will become apparent from the following detailed description of preferred embodiments thereof in connection with the accompanying drawings, and in which like numerals designate like elements:

FIG. 1B shows an enlarged section according to the line B-B in FIG. 1A, FIG. 3 shows formation of vortex vortices at a prior art device.

DETAILED DESCRIPTION OF PREFERRED EMBODIMENTS OF THE INVENTION

Figure 1A:
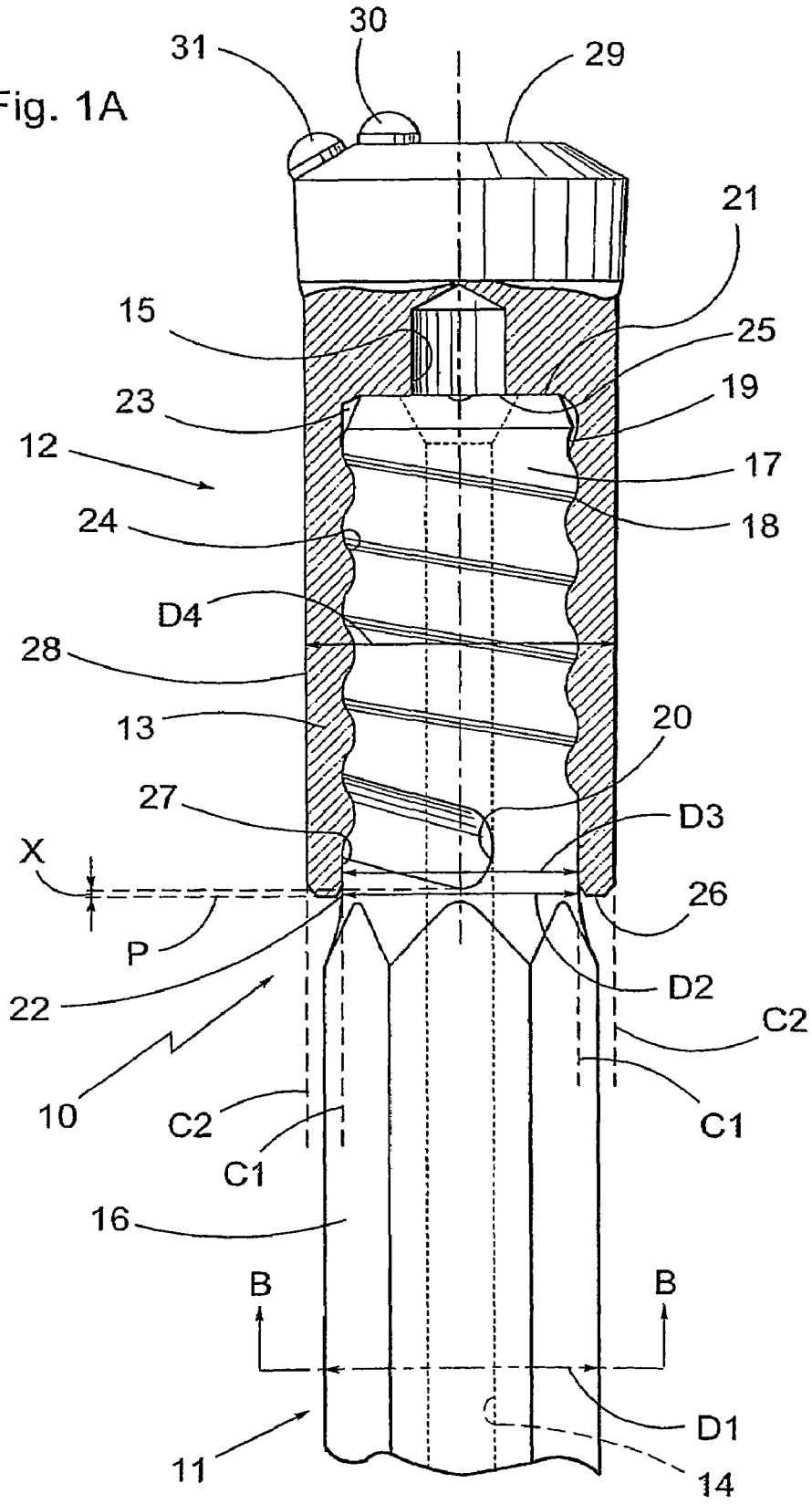
FIG. 1A shows a view of a thread joint according to the present invention shown partly in longitudinal section.

The present invention relates to a thread joint 10 for percussive rock drilling between a first drill rod 11 and a sleeve 13, preferably integrally fastened to a drill bit 12, as is shown in FIG. 1. Alternatively, the sleeve may be integrally fastened to a second drill rod or to a connector tube, not shown. The sleeve 13 has a cylindrical outer surface 28. The drill bit 12 comprises a front surface 29 that accommodates a plurality of front buttons 30 and peripheral buttons 31, only two of which are shown in FIG. 1A. The peripheral buttons 31 define the diameter of the drilled hole in a conventional way.

The drill rod 11, and thereby the thread joint, comprises at least one conduit 14 for transportation of flushing medium, such as water. Said conduit 14 connects to at least one conduit 15 in the drill bit 12. The drill rod 11 has a hexagonal radial cross-section and comprises a first outer surface 16. The drill rod may alternatively have a circular cross-section. The first outer surface 16 has a first outer maximum cross section D1, first end 17 comprises a first end surface 21. The first drill rod 11 comprises a second outer surface 22 having an outer second maximum cross section in the form of a diameter D2. The second outer surface 22 is turned or ground to an accurately defined diameter D2 and has an axial extension from 1 mm to 50 mm. The second outer surface 22 is axially arranged between the first outer surface 16 and the thread end 20. The sleeve 13 comprises a recess 23 that comprises a female thread 24 and an inner stop face 25. The recess 23 connects to a second end surface 26 of the sleeve. The second end surface 26 is substantially ring-shaped. A substantially cylindrical inner surface 27 is arranged between the second end surface 26 and the female thread 24. The inner surface 27 has an inner diameter D3. The thread joint 10 becomes mounted when the spigot 17 has been threaded into the recess 23 until the first end surface 21 abuts against the inner stop face 25. At a mounted thread joint, the dimensions of the parts are arranged in such a way that the second end surface 26 of the sleeve is arranged axially beyond the thread end 20 of the male thread 18 or a thread clearance (e.g., such a thread clearance is shown at 33' in FIG. 2), so that at least a part of the inner surface 27 conceals the weakest cross-section of the first drill rod. The weakest cross-section of the drill rod is the part of the drill rod that has the smallest cross-sectional area, such as at the thread end 20 of the male thread 18 or at a thread clearance 33'. The second end surface 26 of the sleeve is then arranged in a plane P, which intersects the second outer surface 22 axially beyond the thread end 20 of the male thread 18. The distance X between the thread end 20 and the plane P is at least 1 mm. Thus, the second end surface of the sleeve is arranged at least 1 mm axially beyond the thread end of the male thread.

The inner diameter D3 of the inner surface 27 is at least equally large as, maximum 1 mm larger than, the outer second diameter D2 of the second outer surface 22 but smaller than the first outer diameter D1 of the first outer surface 16. The chosen dimensions give relatively small geometrical transitions between the parts 11 and 12 for decreasing the extent of vortex vortices, so that the effect on the extension joint from drill dust and aggressive water decreases. The flushing medium may alternatively consist of an admixture of air and water.

The relatively small geometrical transitions may also be described by defining a first imaginary cylinder C1, which constitutes an axial extension of the inner surface 27 and a second imaginary cylinder C2, which constitutes an axial extension of the outer surface 28 of the sleeve 13, see FIG. 1B. The first imaginary cylinder C1 intersects the drill rod 11 while the second imaginary cylinder C2 extends outside of the drill rod. Thereby, vortex vortices in the transitions or the joints are minimized at the same time as the control of the drill string in the borehole is improved. Both the imaginary cylinders C1 and C2 intersect the peripheral buttons 31.

The outer surface 28 of the sleeve 13 has a third outer maximum cross section in the form of a diameter D4, which is larger than the first outer maximum cross section D1 of the first outer surface 16.

It should be noted that the thread end of the male thread may be arranged within the axial area that the female thread defines and that the cylindrical surface 27 then surrounds a thread clearance and at least a part of the turned or ground second outer surface 22.

Figure 2:
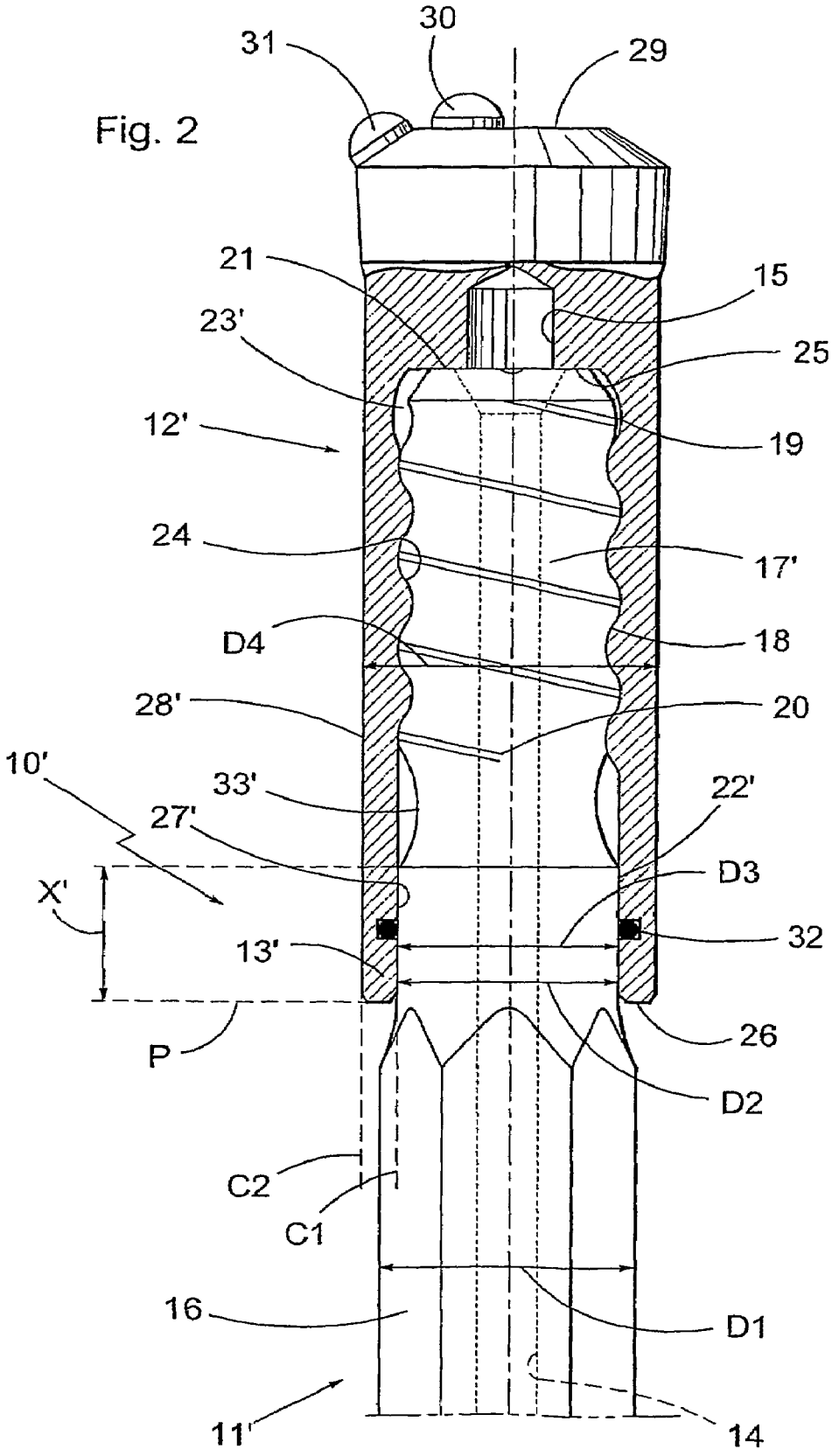
FIG. 2 shows a view corresponding to FIG. 1A showing an alternative embodiment of the invention.

FIG. 2 shows an alternative embodiment of a thread joint 10' according to the present invention. Corresponding parts have been designated with the same reference designations as in FIGS. 1A and 1B. The thread joint 10' has a drill rod 11' and a rock drill bit 12' for percussive drilling. The drill bit 12' has a sleeve 13' having a recess 23' wherein a relatively long, turned or ground inner surface 27' and the female thread 24 are arranged. The outer surface of the sleeve is denominated 28'. The drill rod 11' has a threaded spigot or end 17' and a relatively long, turned or ground second outer surface 22'.

What foremost makes this embodiment different from the one above-described is that the second outer surface 22' and the inner surface 27' have been made axially longer, whereby abutment between the same may be attained along the distance X', so that also an improved control of the rock drill bit 12' is obtained. Furthermore, it is outlined in FIG. 2 that a sealing ring 32, i.e. an O-ring or the like, may be arranged in the inner surface 27' of the sleeve 13' for further decreasing the vortex vortices and the circulation close to the end surface 26 of the sleeve 13'. Furthermore, the embodiment according to FIG. 2 comprises a thread clearance 33'. The thread clearance 33' consists of a circumferential concave recess, which enables clearance for thread tools in chasing of threads of the male thread. The distance X' is in this case measured between the plane P and the thread clearance 33' and is at least 1 mm. Thus, the second end surface of the sleeve is arranged at least 1 mm axially beyond the thread clearance 33'.

Conventional hexagonal and round rock drill rods are rolled and the accuracy in the circumferential direction becomes relatively poor why it is chosen in the thread joint according to the present invention to turn or grind the inner surface 27, 27' for enabling a good abutment between the surfaces 22, 22' and 27, 27'.

Thus, the present invention relates to a thread joint intended only for percussive rock drilling, preferably by means of top hammer drilling. The thread joint 10 is formed in order to reduce the formation of vortex vortices in percussive drilling by minimizing dimension differences between parts included in the joint. The dimensions of the joints are chosen such that blasting effects and corrosion from exterior flush water are reduced and are directed towards greater dimensions of the joint.

The invention claimed is:

1. Apparatus for transmitting percussive forces comprising:

a male member threadedly mounted in a female member by a thread joint, the thread joint comprising a male thread on the male member and a female thread on the female member, the thread joint defining a longitudinal axis;

the male member including a first portion including an outer surface having a maximum first outer cross section, a second portion having a second maximum outer cross section, and a third portion having the male thread formed thereon, the second portion disposed axially between the first and third portions, the male thread including a thread start and a thread end; the third portion terminating in an axially facing first end surface;

the female member comprising a recess in which the female thread is formed, the female thread having a mouth defined by a ring-shaped second end surface, the recess including a stop face abutted by the first end surface, the recess including a cylindrical inner surface disposed between the second end surface and the female thread, the inner surface facing the male member, wherein the inner surface has a diameter at least as large as the second maximum outer cross section, and smaller than the first maximum outer cross section;

wherein the thread end of the male thread is situated within the recess;

wherein a first imaginary cylinder constituting an axial extension of the inner surface intersects the first portion of the male member, and a second imaginary cylinder constituting an axial extension of an outermost surface of the female member extends outside of the first portion of the male member;

the male and female members forming a conduit for transporting a flushing medium.

2. The apparatus according to claim 1 wherein the male member includes a recess disposed between the thread end and the second portion of the male member, wherein the recess defines a thread clearance and is disposed within the recess.

3. The apparatus according to claim 2 wherein the second end surface of the female member is disposed at least 1.0 mm axially past the thread clearance.

4. The apparatus according to claim 3 wherein the cylindrical inner surface has a diameter which is larger than the second maximum outer cross section by no more than 1.0 mm.

5. The apparatus according to claim 4 wherein the second portion is of cylindrical shape.

6. The apparatus according to claim 1 wherein the second end surface of the female member is disposed at least 1.0 mm axially past the thread end.

7. The apparatus according to claim 1 wherein the cylindrical inner surface has a diameter which is larger than the second maximum outer cross section by no more than 1.0 mm.

8. The apparatus according to claim 1 wherein the second portion is of cylindrical shape.

9. The apparatus according to claim 1 wherein the female member comprises a drill bit having cutting buttons disposed thereon including radially outermost buttons, wherein each of the first and second imaginary cylinders intersect the radially outermost buttons.

10. The apparatus according to claim 1, wherein the second portion of the male member has a constant cross-section from the male threaded region to at least where a plane including the second end surface intersects the male member.

11. A combination for percussive rock drilling, comprising a drill rod including a male threaded region on a first end and an outer maximum cross-section of the threaded region is smaller than a cross-section of a second region on a second end of the drill rod, wherein the second region has a length in an axial direction greater than a length in the axial direction of the male threaded region;

a drill bit including a front surface accommodating a plurality of front buttons and peripheral buttons, a sleeve rearward of the front surface and terminating rearwardly in a second end surface, a recess in the sleeve including an inner stop face at a forward end and an inner surface wall, the inner surface wall including a female threaded portion and an unthreaded portion, and at least one conduit between the recess and the front surface for transportation of flushing medium; and a threaded joint between the drill rod and the drill bit.

12. The combination according to claim 11, wherein the drill rod includes a thread clearance.

13. The combination according to claim 12, wherein the thread clearance consists of a circumferential concave recess.

14. The combination according to claim 11, wherein the recess at the unthreaded portion has an inner diameter and an outer diameter and wherein the drill rod which has been threaded with the drill bit has a maximum outer diameter that is between the inner diameter and the outer diameter.

15. The combination according to claim 11, wherein a portion of the drill rod with the smallest cross-sectional area is axially forward of the second end surface.

16. The combination according to claim 11, wherein a first imaginary cylinder is defined by an axial extension of the inner surface wall at the unthreaded portion and a second imaginary cylinder is defined by an axial extension of an outer surface of the drill bit, and wherein the first imaginary cylinder intersects the drill rod and the second imaginary cylinder extends radially outward of the drill rod.

17. The combination according to claim 16, wherein both the first imaginary cylinder and the second imaginary cylinder intersect the peripheral buttons.

18. The combination according to claim 11, wherein the second end surface is substantially ring-shaped.

19. The combination according to claim 11, wherein the unthreaded portion is substantially cylindrical-shaped.

20. The combination according to claim 11, wherein the at least one conduit has one end at the inner stop face.

21. The combination according to claim 11, wherein the inner stop face, female threaded portion and unthreaded portion are arranged axially from the forward end of the recess to a rearward end of the recess.

22. The combination according to claim 11, wherein a drill rod inserted into the recess has a male thread with a rearward terminus that is axially forward of the second end surface.

23. The combination according to claim 22, wherein a plane containing the second end surface of the sleeve is axially separated by a distance of at least 1 mm from a plane containing the rearward terminus and perpendicular to an axis of the drill rod.

24. The combination according to claim 11, wherein the recess at the unthreaded portion has an inner diameter and an outer diameter and wherein an outer diameter of the drill rod to be threaded with the drill bit has a maximum length that is between a length of the inner diameter and a length of the outer diameter.

25. The combination according to claim 11, comprising a sealing ring arranged in the inner surface wall of the sleeve.

26. The combination according to claim 11, wherein the recess in the sleeve includes a sealing ring in the unthreaded portion.

27. The combination according to claim 11, wherein the peripheral buttons define a diameter of a hole drilled with the drill bit.

28. The combination according to claim 11, wherein the drill rod has a constant outer maximum cross-section over at least a portion of the drill rod in the axial direction from the male threaded region to at least where a plane including the second end surface intersects the drill rod.

29. The combination according to claim 11, wherein the second end surface is exposed.

* * * * *